United States Patent [19]

Teramoto et al.

[11] Patent Number: 4,645,207

[45] Date of Patent: Feb. 24, 1987

[54] SET OF GOLF CLUB IRONS

[75] Inventors: Mitsutake Teramoto, Kamakura; Shinkichi Saito, Tokyo; Takamitsu Takebayashi, Musashino, all of Japan

[73] Assignee: The Yokohama Rubber Co., Ltd., Tokyo, Japan

[21] Appl. No.: 758,994

[22] Filed: Jul. 25, 1985

[30] Foreign Application Priority Data

Jul. 26, 1984 [JP] Japan ..... 59-154051

[51] Int. Cl.[4] ..... A63B 53/04

[52] U.S. Cl. ..... 273/77 A; 273/167 H; 273/169

[58] Field of Search ..... 273/167 H, 169, 167 A, 273/174, 77 A, 167 F, 170, 171, 172, 173, 175

[56] References Cited

U.S. PATENT DOCUMENTS 1,945,844 2/1934 Young ..... 273/174
2,447,967 8/1948 Stone ..... 273/77 A
3,059,926 10/1962 Johnstone ..... 273/77 A
3,751,035 8/1973 Lockwood ..... 273/167 A
4,444,392 4/1984 Duclos ..... 273/77 A

*Primary Examiner*—George J. Marlo
*Attorney, Agent, or Firm*—Armstrong, Nikaido, Marmelstein & Kobovcik

[57] ABSTRACT

A set of iron golf clubs, in which a grip is disposed at one end and a club head is disposed at the other end of a shaft, the length of the shaft is gradually decreased and the loft angle is gradually increased from a longer iron to a shorter iron, wherein the structure of the club head is made such that a hollow structure is taken for longer irons and a solid structure is taken for shorter irons in which the volume of hollow portion is gradually decreased as the number of the club changes from side of the longer iron to the shorter iron. The sole width of the club head gradually increases as the number of the club changes from the shorter irons to the longer irons.

4 Claims, 9 Drawing Figures

SET OF GOLF CLUB IRONS

BACKGROUND OF THE INVENTION

This invention concerns an improvement in or relating to a set of iron golf clubs and, more specifically, it relates to a set of iron golf clubs which can fully attain the functions required for the iron golf clubs of respective numbers.

It is generally designed in iron golf clubs such that the length of a shaft is gradually decreased and the loft angle is gradually increased from the long iron (No. 1 iron) to the short iron (No. 9 iron).

Since a long iron is used when a large flight distance is required, the shaft is made longer and the swing action upon hitting the ball is necessarily large. Accordingly, it is difficult to just meet the ball with the club. This trend becomes remarkable from the short iron (No. 9 iron) to the longer iron (No. 1 iron) and the skill necessary to just meet the ball with the No. 2 or No. 1 iron is so difficult that a beginner cannot use such clubs.

Since a short iron of No. 7, 8 or greater number is mainly used for the approach, it has a relatively short shaft length as compared with those of long irons described above, and the back swing action upon hitting the ball may not necessarily be so large. However, since the accuracy is required for the direction of flight and the flight distance of the ball, easy control upon hitting is required.

By the way, in the conventional set of iron golf clubs, it is difficult to design clubs for all of the numbers which will swing with a similar feeling, as well as it is also difficult to obtain a large flight distance and accurate directional control of the ball with longer irons and to obtain accurate directionality and accurate flight distance with shorter irons.

Accordingly, it has been difficult in the design of conventional set of iron golf clubs to sufficiently attain the different functions of the clubs required for the respective numbers of the iron golf clubs.

SUMMARY OF THE INVENTION

This invention has been devised in view of the foregoing problems as described above and a first object thereof is to provide a set of iron golf clubs, by which stable swing and shot can be attained with all of the iron clubs from the short iron to the long iron.

Further, a second object of this invention is to provide a set of iron golf clubs enabling a user to swing each of the clubs with a similar feeling throughout all of the numbers of the iron golf clubs, obtaining a large flight distance and accurate directionality of a ball with the longer irons and accurate directionality and accurate flight distance with the shorter irons, as providing a set of clubs which are well as capable of attaining the functions of the clubs required for the respective number of iron golf clubs.

A third object of this invention is to provide a set of iron golf clubs that can be inexpensively manufactured by a simple process.

BRIEF DESCRIPTION OF THE DRAWINGS

FIG. 1 through FIG. 4 show an embodiment according to this invention, in which, FIG. 1 is a front elevational view of an iron golf club, FIG. 2 is a partially cut-away side elevational view showing a portion of the iron golf club, FIGS. 3(*a*), (*b*), (*c*) are, respectively, explanative side elevational views showing essential portions of an embodiment of this invention, in which (a) is for the No. 1 iron, (b) is for the No. 5 iron and (c) is for the No. 9 iron, FIGS. 4(*a*), (*b*), (*c*) are, respectively, explanatory side elevational views showing essential portions of another embodiment.

DETAILED DESCRIPTION OF THE INVENTION

This invention will now be described in connection with its preferred embodiments, referring to the accompanying drawings.

Figure 1:
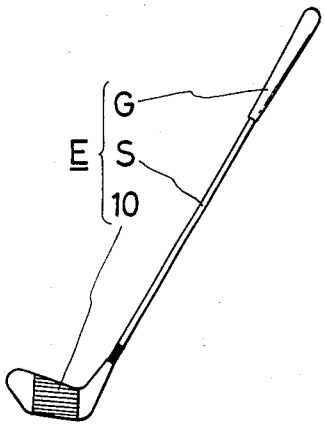
Figure 2:
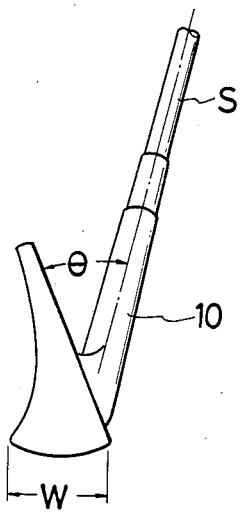

In FIG. 1 and FIG. 2, a set of iron golf clubs E of one embodiment according to this invention comprises a plurality of iron golf clubs E1 to E9, in which a grip G is attached at one end of a shaft and a club head 10 is attached at the other end of the shaft S. The length of the shaft S is decreased gradually and the loft angle $\theta$ is increased gradually for each club from the long iron E1 to the short iron E9.

Particularly, in this invention, the club head 10 has a hollow portion for the long irons E1 to E7 or E1 to E5, while it is made solid for the short irons E8, E9 or E6 to E9, in which the volume of the hollow portion is gradually decreased from the long iron E1 to the short iron E9 along with the change of the numbers.

Furthermore, in this embodiment, the sole width W of the club head 10 is gradually increased from the short iron E9 to the long iron E1 along with the change of the numbers.

Figure 3:
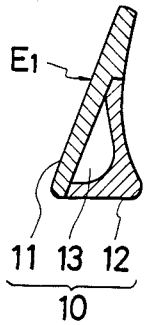
Figure 3:
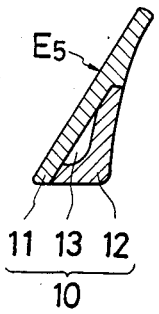
Figure 3:
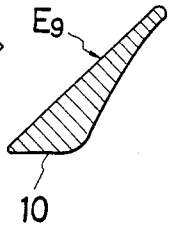

In This embodiment, each one of the set of iron golf clubs E is prepared as shown in FIG. 3 by separately forming two portions, that is, a face member 11 and a back member 12 substantially of an L-shaped configuration by the lost wax method and integrating the back member 12 by welding at the back of face member 11 to form a hollow portion 13 as shown in the drawing.

The volume of hollow structure in the hollow portion 13 is adjusted by the design of the L-shaped back member 12 as described above and the center of gravity for the head is gradually displaced toward the rear side of the club in the longer irons.

The relationship between the volume of hollow portion and the number of the club is desirably changed by the design depending on the classes of golf players using the set of iron golf clubs (expert class, experienced class and beginner class).

In Experimental Examples later to be described, the volume of hollow portion is gradually decreased from No. 1 to No. 7 clubs, and the structure is made solid for the No. 8 and larger number clubs, while the volume of hollow portion is decreased gradually from No. 1 to No. 5 clubs and the structure is made solid for the No. 6 and the larger number clubs in Experimental Example 2.

Although this invention is particulalry suitable to iron club heads prepared by the lost wax method, the iron club heads can also be prepared by casting.

Figure 4:
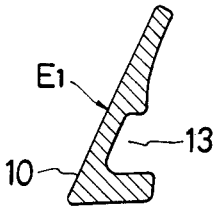
Figure 4:
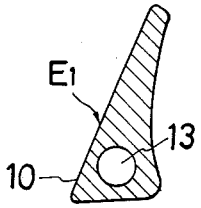
Figure 4:
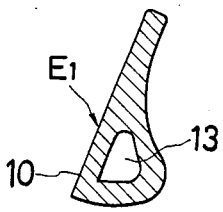

Further, with respect to the hollow structure of the iron club head, although the hollow portion 13 is formed by welding the back member 12 generally formed in an L-shaped configuration to the back of the face member 11 as described in the foregoing embodiment, it is also possible to form the hollow portion 13 by directly forming a recess at the back of the face member 11 as shown in FIG. 4(*a*), or to directly form the hollow portion 13 by boring an opening at the top end surface at the toe of the face member 11 as shown in FIGS. 4(*b*) and 4(*c*).

Figure 5:
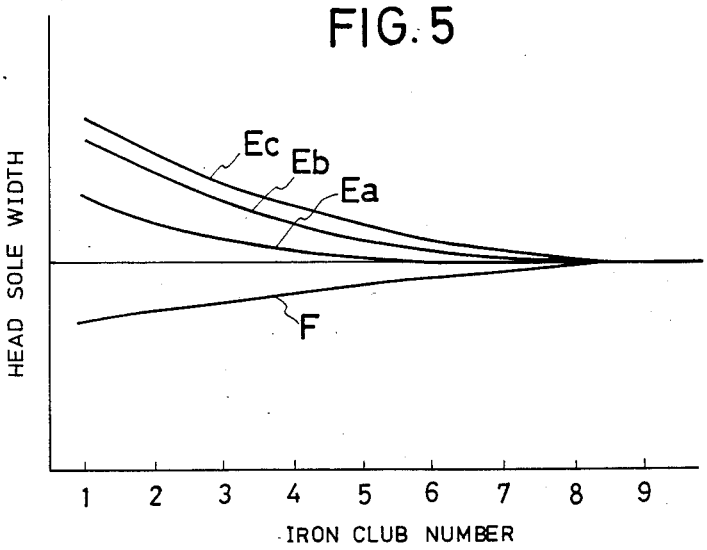
FIG. 5 is a graph, illustrating the relationship between the sole width of the head and the numbers of the clubs for the set of iron golf clubs of this invention and for that of conventional ones.

FIG. 5 shows the relationship between the numbers of the iron golf clubs and sole width W of the head 10. The sole width W is generally increased for the shorter iron clubs as shown by the curve F in the conventional set of iron golf clubs. Quite to the contrary, the sole width W (FIG. 2) measured across the widest part of the sole is increased for the longer iron clubs 1 as shown in the curves Ea, Eb, Ec in the set of the iron golf clubs according to this invention. It is of course possible to change the relationship between the number of clubs and the sole width W of the head 10 along with the purpose as described above.

EXPERIMENTAL EXAMPLE 1

Iron club heads 10 from No. 1 to No. 9 were made of a stainless steel as the raw material by way of the lost wax method.

As shown in FIG. 3, the face member 11 and the back member 12 were separately prepared by the lost wax method and then the members were integrated by welding to form the hollow portion 13 as shown in FIG. 3. The number, the sole width (W in FIG. 2) and the structure in the set of the iron golf club heads are made as shown in Table 1.

TABLE 1

| Item | | Iron No. #1 | #2 | #3 | #4 | #5 | #6 | #7 | #8 | #9 |
|---|---|---|---|---|---|---|---|---|---|---|
| Loft angle (degree) | | 17 | 19 | 22 | 25 | 28 | 32 | 36 | 40 | 45 |
| Head weight (g) | | 240 | 245 | 250 | 255 | 260 | 265 | 270 | 275 | 280 |
| Sole width | Heel portion (mm) | 18.9 | 18.4 | 17.9 | 17.4 | 16.9 | 16.3 | 15.8 | 15.3 | 14.8 |
| | Toe portion (mm) | 28.6 | 27.8 | 26.9 | 26.1 | 25.3 | 24.5 | 23.7 | 22.8 | 22.0 |
| Structure | | hollow | | | | | | | solid | |

The set of iron club heads obtained in this way were assembled into clubs and tried to obtain the result as below.

Specifically, the center of gravity of the head is lowered for the smaller number head of the longer irons and the sweet spot is larger. Accordingly, with long irons of any number, the chance of misshot is decreased considerably even when a large back swing is taken and the directionality of flight can be improved significantly and a large flight distance can also be obtained; in contrast it has been difficult so far to just meet the ball with the conventional iron golf clubs of small numbers.

This enables the user to swing the No. 3, No. 2 and No. 1 long irons at ease, which have hitherto been not favoured for the fear of a misshot.

Further, with respect to the short irons, club control upon hitting the ball can significantly be facilitated, in which accurate direction of ball flight and accurate flight distance can be obtained with any number of the shorter irons.

Furthermore, the weight, the sole width and the depth for the center of gravity of the head can easily be adjusted depending on the number of each club and the club regardless of its number can be swung with a similar feeling.

Accordingly, a large flight distance of the ball and accurate directionality can be obtained for the longer irons, while accurate directionality and flight distance can be obtained for the shorter irons, by which the functions required for the respective numbers of the iron golf clubs can fully be attained.

EXPERIMENTAL EXAMPLE 2

In the same manner as in Experimental Example 1, a set of iron golf clubs were prepared with the number in the set of iron golf clubs, the sole width and the structure as shown in Table 2.

TABLE 2

| Item | | Iron No. #1 | #2 | #3 | #4 | #5 | #6 | #7 | #8 | #9 |
|---|---|---|---|---|---|---|---|---|---|---|
| Loft angle (degree) | | 17 | 19 | 22 | 25 | 28 | 32 | 36 | 40 | 45 |
| Head weight (g) | | 240 | 245 | 250 | 255 | 260 | 265 | 270 | 275 | 280 |
| Sole width | Heel portion (mm) | 17.4 | 16.9 | 16.3 | 15.8 | 14.8 | ← | ← | ← | ← |
| | Toe portion (mm) | 26.1 | 25.1 | 24.1 | 23.0 | 22.0 | ← | ← | ← | ← |
| Structure | | hollow | | | | | | | solid | |

When the set of the iron club heads obtained in this way were assembled into clubs and tried for the shot, the same effect as in the Experimental Example 1 described above could be obtained.

Since the ratio of the hollow portion and the solid portion in the set of the iron golf clubs was made such that the structure from the No. 6 and larger number clubs was made solid in the Experimental Example 2 while the structure was made solid from the No. 8 and larger number clubs in Experimental Example 1, the clubs in the Experimental Example 2 seemed to be somewhat more suitable to the upper grade players from the result.

As described above, in the set of a pluraity of iron golf clubs in which a grip is formed at one end and a club head is formed at the other end of a shaft, the length of the shaft is gradually decreased while the loft angle is gradually increased from the long irons to the short irons, since the club head has a hollow portion in the longer irons and no hollow portion in the shorter irons, and the volume of the hollow portion is gradually decreased from the longer irons to the shorter irons as the number of the clubs changes in accordance with this invention, the depth of the center of gravity for the head can be increased as the number is decreased to make the sweet spot larger. As a result, in any number of the longer irons, a larger back swing action can be taken while significantly decreasing the fear of misshot, directionality of the ball flight can be controlled accurately, and larger flight distance can also be obtained. Accordingly, No. 3, No. 2 and No. 1 long irons, which have not been preferred so far because of the possibility of misshot, can now be swung at ease.

Furthermore, with respect to the shorter irons, club control upon hitting the ball can significantly be facilitated.

As a result, accurate ball flight direction and accurate flight distance can be obtained in any number of shorter irons. Accordingly, a user's score can be improved.

As described above, according to this invention, clubs of all of numbers can be swung with a similar feeling, in which the larger flight distance of the ball and accurate directionality can be obtained on the longer irons, while accurate directionality and accurate flight distance can be obtained in the shorter iron clubs, so that the functions required for the respective number of iron golf clubs can fully be attained.

What is claimed is:

1. A set of golf club irons, each including a shaft, a grip disposed at one end of the shaft, and a club head disposed at the other end of the shaft, the lengths of such irons being gradually decreased and the loft angles of the club heads being gradually increased from the longer irons to the shorter irons, the club heads of the longer irons having a hollow portion therein and the club heads of the shorter irons being devoid of any hollow portions therein, the volumes of said hollow portions in said longer irons being gradually decreased to zero as the number of the club changes from the longer irons to the shorter irons.

2. A set of iron golf clubs as defined in claim 1, wherein the sole widths of the club heads measured across a widest part of the soles of the club heads are gradually increased as the number of the club changes from the shorter irons to the longer irons.

3. A set of iron golf clubs as defined in claim 1, wherein each longer iron club head comprises a face member and a back member of generally L-shaped configuration integrally joined thereto and defining the hollow portion, the volume of the hollow portion being adjusted and the center of gravity for the head being displaced rearward by the size and shape of the back member.

4. A set of iron golf clubs as defined in claim 1, wherein the hollow portion of each longer iron club head is defined by an opening directly bored at the top end face of the toe portion of the club head.

* * * * *